United States Patent [19]

Otten

[11] Patent Number: 4,486,957

[45] Date of Patent: Dec. 11, 1984

[54] DRAWING MACHINE CARRRIAGE

[75] Inventor: Heinrich Otten, Wilhelmshaven, Fed. Rep. of Germany

[73] Assignee: Franz Kuhlmann Praezisionsmechanik und Maschinenbau GmbH & Co. KG, Wilhelmshaven, Fed. Rep. of Germany

[21] Appl. No.: 460,486

[22] Filed: Jan. 24, 1983

[30] Foreign Application Priority Data

Jan. 25, 1982 [DE] Fed. Rep. of Germany ..... 3202234
Jan. 25, 1982 [DE] Fed. Rep. of Germany ..... 3202243

[51] Int. Cl.[3] ..... B43L 13/02
[52] U.S. Cl. ..... 33/438
[58] Field of Search ..... 33/438, 430, 403

[56] References Cited

U.S. PATENT DOCUMENTS

| | | | |
|---|---|---|---|
| 3,074,173 | 1/1963 | Little | 33/438 |
| 3,279,073 | 10/1966 | Ardito et al. | 33/438 |
| 3,390,462 | 7/1968 | Faul | 33/438 |
| 3,400,461 | 9/1968 | Faul | 33/438 |
| 3,673,691 | 7/1972 | Gilbert | 33/438 |
| 3,908,276 | 9/1975 | Kool | 33/438 |
| 4,145,815 | 3/1979 | Otten et al. | 33/438 |
| 4,315,371 | 2/1982 | Kotani et al. | 33/1 M |

FOREIGN PATENT DOCUMENTS

| | | | |
|---|---|---|---|
| 6602986 | 7/1969 | Fed. Rep. of Germany . | |
| 2107175 | 9/1972 | Fed. Rep. of Germany | 33/438 |
| 2642409 | 3/1978 | Fed. Rep. of Germany . | |

*Primary Examiner*—Harry N. Haroian
*Attorney, Agent, or Firm*—Pearne, Gordon, Sessions, McCoy, Granger & Tilberry

[57] ABSTRACT

A drawing machine carriage has a horizontal carriage which is driven on a horizontal guide rail. A vertical guide rail is positioned on this carriage, and a vertical carriage which supports a drawing head is driven on the vertical guide rail. Brakes for the horizontal carriage are activated by an operational element through a transmission. The operational element is located on the vertical carriage. To achieve ease of operation of the operational element and of the vertical carriage by the application or non-application of the brakes of the horizontal carriage and without the continuous stress of wear by the force of the braking mechanism, the operational element, by means of the transmission, shifts the brakes out of the unbraking neutral position and into a releasably retained braking position, whereby the tension on the operational element and the transmission are released in the neutral position and the braking position.

18 Claims, 5 Drawing Figures

E
F
C
D
3
39
44
47
46
32
31
36
34
30
38
42
43
2
40
24
12
18
A
B

DRAWING MACHINE CARRRIAGE

BACKGROUND OF THE INVENTION

1. Field of the Invention

This invention relates to a drawing machine carriage comprising a carriage which is horizontally movable on a horizontal guide rail and a vertical guide rail with a vertically movable carriage. The carriage supports a drawing head and a brake for the horizontal carriage such that the brake is activated by an operational element mounted on the vertical carriage by means of a transmission.

2. Description of the Prior Art

One such drawing machine carriage which is shown in German Patent No. 25 07 446 utilizes a cable pulley as the transmission, whereby the cable operates over casters on the braking lever and on the underside of the vertical guide rail, and the end of the cable is secured to the operational lever. In the first position of the operational lever, the cable tension is provided with a predetermined first tension against the load spring of the brake lever, which is in the neutral position. In a second position of the operational lever, the cable is more firmly stretched over a dead center and in response to the greater cable tension, the brake lever is shifted into the braking position. The disadvantage of this braking mechanism is in particular that the transmission and the operational lever are under a relatively large force load in both the neutral position and the braking position. This causes a relatively constant stress on the linking casters by the cable tension, which results in labored operation of the operational element, since the operational element can be first moved to either the braking position or the neutral position when the requisite force has been overcome. The user must exercise relatively large torque on the operational lever in order to release the brake. Thus, the vertical carriage moves in a halting manner which is undesirable.

SUMMARY OF THE INVENTION

The present invention sets forth a solution to the problems of prior art drawing machines. The present invention provides a drawing machine carriage of the general construction previously discussed which provides smooth shifting of the operational element to reliable and self-braking halt and which remains smooth as the brakes are released. It also results in easy movement of the vertical carriage both when the brakes are applied and released and when the carriage is sliding, without the wear-producing constant stress.

The present invention provides an operational element which shifts the brakes from the non-braking neutral position into a releasably locked braking position by means of a transmission, and further provides an operational element and a transmission which are not loaded or under stress in the neutral position or in the braking position.

The advantage of the present invention in particular is that the brakes are releasably retained in the braking position and the transmission, as well as the operational element, are under less stress, while the brakes work reliably and with less possibility of failure. Similarly, the transmission, as well as the operational element, are under less stress in the neutral position. Since no forces are transmitted between the operational element and the transmission in the neutral position and in the braking position, respectively, the operational element which is located on the vertical carriage slides easily along the length of the transmission whenever the vertical carriage is moved. Moreover, the operational element can be put in the braking position from the unstressed neutral position without the prior initial loading of the braking mechanism. In the same way, the brakes can be released from the braking position without the necessity of overcoming the stress which arises from application of the braking mechanism. Should the user desire, the operational element or the pivot lever of the brake may be spring-loaded to achieve force or movement independent of the loading of the braking mechanism.

It is preferable that the transmission extend as a unit along the entire length of the horizontal guide rail and form a rod positioned to pivot or rotate longitudinally, and which operates one of the ends of the activated pivot or brake lever. The operational element pivots the pivot lever through the activation means of the rod in the braking position, in which position the pivot lever is releasably secured by a retainer and, as a consequence, the stress on the rod and the operational element is alleviated. Should the brakes subsequently be released, the operational element is held with the rod by means of the retainer, whereby the pivot lever, as well as the rod and the operational element, are returned to their neutral positions through an appropriate return force.

The rod is preferably a pinion or key shaft design with teeth parallel to the axis. The pivot lever swivels about an axis which runs generally parallel to the pinion rod and which is equipped on one end with a pinion segment which engages the pinion rod. The operational element is preferably a press key design which displaces a slide bar that extends across to the pinion rod and thereby engages and rotates the pinion rod.

In the neutral position, no forces operate between the pivot lever, the pinion rod, and the slide bar. The slide bar can thus easily slide along the pinion rod. The vertical carriage does not experience undesirably large resistance through sliding friction between the pinion rod and the slide bar. Since the pivot lever is secured in the braking position by the retainer, there is also essentially no force in the braking position between the pivot lever, the pinion rod, and the slide bar of the press key assembly. Therefore, in the braking position as well, easy displacement of the vertical carriage along the vertical guide rail is pos- sible.

When the horizontal guide rail is pivotally secured longitudinally on the drawing board, there generally exists a rigid junction between the vertical carriage and the horizontal carriage of a square frame. In accordance with the present invention, the horizontal brake is constructed and coupled to the transmission in a manner so that when the vertical guide rail is lifted from the drawing board, the brake will continue to hold when it is in the drawing position.

In order to hold to a minimum the forces in applying the brake transmitted over the pinion rod, the brake is provided with a plunger which is axially slidable in a sleeve. Both the plunger and the sleeve have brake linings which interact. The horizontal guide rail preferably has a special brake slot which accommodates the brake and has a narrow opening through which the shaft of the plunger projects and extends through a sleeve which is positioned opposite it. The plunger and sleeve are connected to each other through a toggle lever which is operated by the pivot lever and which is extended when the brakes are applied. As a result of this construction, relatively modest forces are required on the pivot lever to produce the necessary braking force.

The pivot lever is biased to its neutral position by means of a first return spring. The pinion segment which engages the pinion rod is movably positioned relative to the pivot lever. When the brakes are released from the braking position, the pinion segment is movable a slight distance against a second, firmer return spring from the braking position while the pivot lever remains in the braking position. In this manner, the pinion segment is correspondingly moved from the braking position by the additional rotational movement of the pinion rod and is thereby released by the retainer so that the pivot lever is also released and the first return spring causes it to return to its neutral position. The rotational movement of the pinion rod and its engagement with the pinion segment as they shift from the braking position provide for the press key which forms the operational element to be easily pressed to operate against the second, firmer return spring as the brakes, the pivot lever, the pinion rod, and the press key are returned to their neutral positions.

Further embodiments of the invention are revealed in the following description.

DETAILED DESCRIPTION OF THE PREFERRED EMBODIMENT

Figure 1:
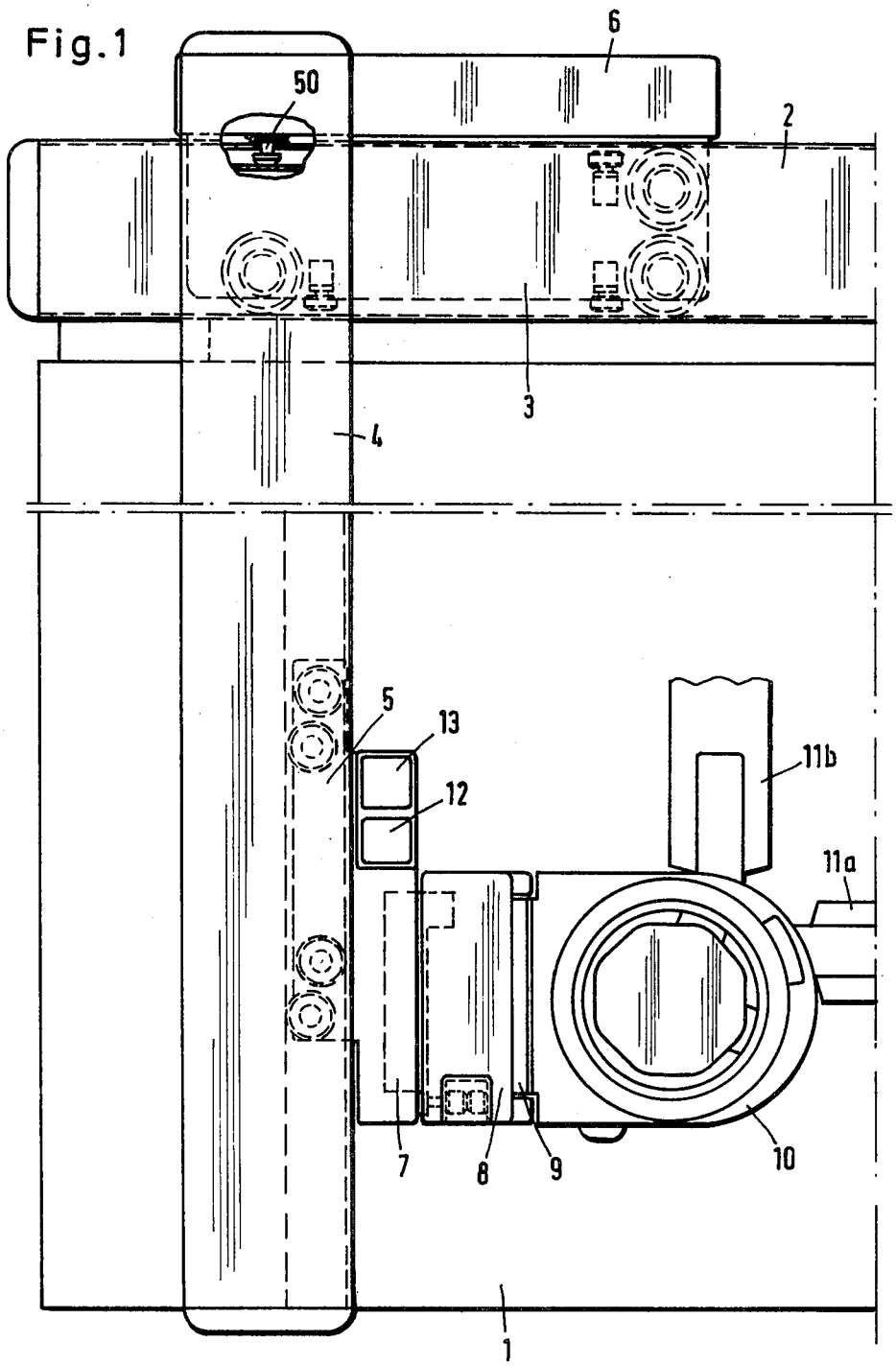
FIG. 1 is a plan view of the drawing machine carriage in accordance with the present invention.

The drawing machine carriage shown in FIG. 1 has a horizontal guide rail 2 which is joined to a drawing board 1. Driven along the guide rail 2 is a horizontal carriage 3 which, on a square frame 6, carries a vertical guide rail 4 for a vertical carriage 5. The carriage 5 is joined to an intermediate member 8 by means of a link 7. The drawing head 10 with rulers 11*a* and 11*b* is secured by a bridge 9 to the intermediate member 8.

On the carriage 5 is a press key assembly 12–18 which operates a brake on the horizontal carriage 3 and which can be activated to hold or lock the horizontal carriage 3 when so desired. A second press key 13 which activates the corresponding brake on the vertical carriage 5 in order to lock this carriage is located next to the press key assembly 12–18. The axes of operation of both press keys 12,13 run perpendicular to the drawing plane to limit the development of force components in the direction of operation of the carriages 5,6. The carriages 5,6 thus remain in the position previously adjusted by the proper operation of their brakes.

Figure 2:
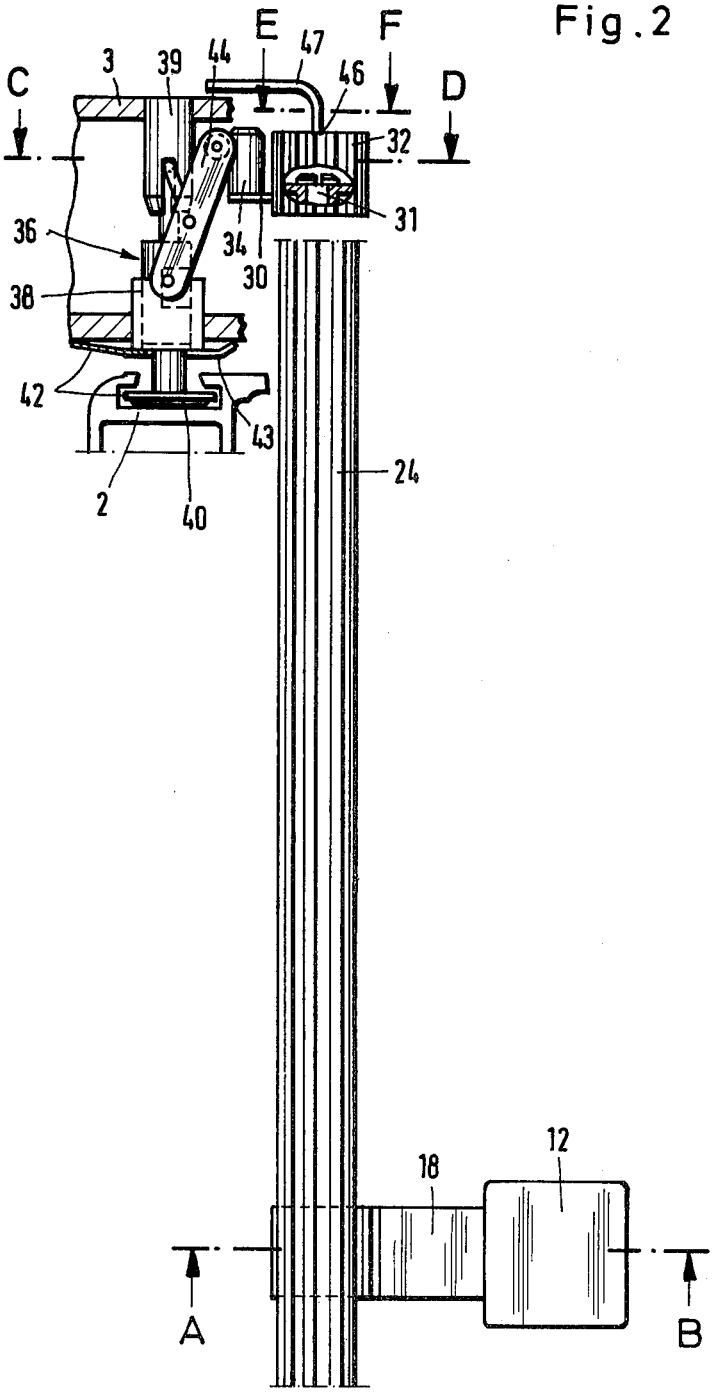
FIG. 2 is a schematic plan view of the brakes for the horizontal carriage.
Figure 3:
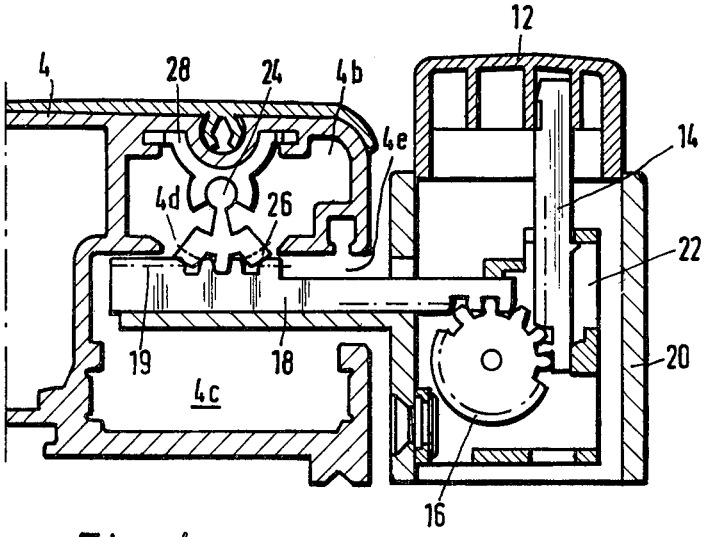
FIG. 3 is a cross section along line A–B of FIG. 2.

As is shown in FIGS. 2 and 3, there is a transmission formed by an elongated pinion rod 24 which has teeth extending parallel to the axis of the rod and which is located in a chamber 4*b* which extends along the total length of the horizontal guide rail 4. The pinion rod 24 is held in a collar 28 so that it can be pivotally moved or rotated about its longitudinal axis. The teeth 26, which run parallel to the axis of the pinion rod 24, project through an opening 4*d* of the guide rail 4 adjacent to the pinion rod 24 and extend into an elongated side slot 4*e* in the guide rail 4. Extending through the slot 4*e* is a slide bar 18 with teeth 19 parallel to the axis of the pinion rod 24 that engage the teeth of the pinion rod 24. The slide bar 18 moves beneath the key body 12 and provides the connection between the pinion rod 24 and a rotatable pinion gear 16. The pinion gear 16 is driven by a gear rack 14 which is tightly joined to the bottom of the key body 12. The key body 12, the gear rack 14, the pinion gear 16, and the slide bar 18 comprise the operational element 12–18 for the horizontal brake.

Figure 4:
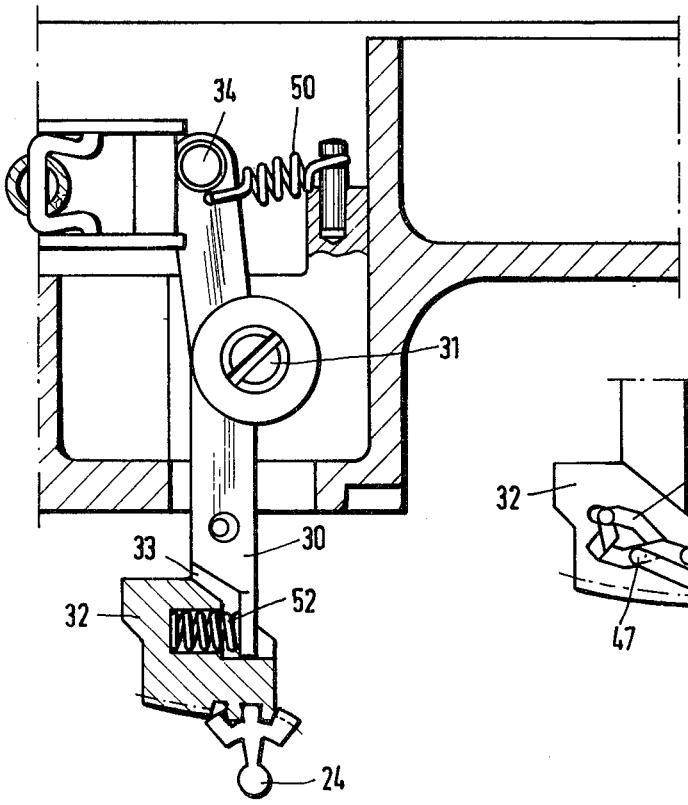
FIG. 4 is a cross section along line C–D of FIG. 2.

As shown in FIG. 4, the pinion rod 24 on its other side engages a pinion segment 32 that is positioned on one end of a double-armed pivot lever 30 which pivots about an axis 31 generally parallel to that of the pinion rod 24 and which activates the brake 36 by its other end 34.

The slide bar 18 is pulled from the vertical guide rail 4 and is moved out of its neutral position by activating the press key assembly 12–18. The pinion rod 24 is gripped and pivoted toward the right, and thereby the pinion segment 32 of the pivot lever 30 is also pivoted toward the right. The free end 34 of the pivot lever 30 is pivoted toward the left, thereby shifting the brake 36 into the braking position. The pivot lever 30 is releasably held in the braking position by a retainer 46 and as a result, the pinion rod 24, as well as the press key assembly 12–18, are relieved from stress.

As shown in FIG. 2, the brake 36 has a plunger 40 which is positioned in a slot in the horizontal guide rail 2. The plunger 40 is mounted on a shaft 39 which is axially slidable within a sleeve 38. The sleeve 38 is freely mounted on the horizontal carriage 3 by means of two springs 43. The sleeve 38 is slidably movable in the axial direction to compensate for discrepancies in spacing between the guide rail 2 and the housing which accommodates the brakes 36. The sleeve 38 is provided with brake linings 42 on each of the surfaces under the spring 43 and on the plunger 40. An edge of the horizontal guide rail 2 is held between the brake linings 42.

The sleeve 38 and the plunger 40 are connected by a toggle lever 44 which is moved by the transition of the pivot lever 30 to its braking position, the pinion rod 24 thereby producing a relatively large braking force with relatively modest torque.

As is shown in FIG. 4, the pivot lever 30 is biased in its neutral position by a first return spring 50.

The pinion segment 32 which engages the pinion rod 24 is movable with respect to the support arm 33 on the end of the pivot lever 30. The support arm 33 likewise pivots about the rotational axis 31. A second, firmer return spring 52 operates between the pivot lever 30 and the pinion segment 32. The second return spring 52 further operates on the pinion segment 32 of the press key assembly 12–18 so that when the pinion segment 32 is moved only slightly beyond its braking position by means of the pinion rod 24, the retainer 46 is released and the pinion segment 32, as well as the pivot lever 30, are released. This additionial rotational motion can be easily realized by means of the press key assembly 12–18 so that it is possible to guide the press key assembly 12–18 out of the braking position. This produces additional movement of the pinion rod 24, and thereby of the pinion segment 32, whereby the retainer 46 is released and the return spring 50 causes the pivot lever 30 to return to the neutral position and the pinion rod 24 causes the press key body 12 likewise to return to the neutral position.

Figure 5:
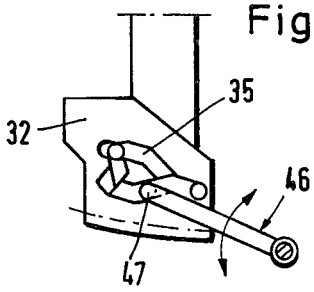
FIG. 5 is a cross section along line E–F of FIG. 2; in enlarged representation.

As is shown in FIGS. 2 and 5, the retainer 46 has a retainer pin 47 which is spring-biased against the pinion segment 32 and which extends into the pinion segment 32. The pin 47 moves within a closed cam path 35 which extends diagonally from the neutral position of the pin to the braking position and in the same direction from the braking position to the neutral position, and which decreases by steps from one position to the other. The retainer 46 is securely positioned at the braking position through steps in the cam path 35 and is released from the braking position by moving the pin a short distance beyond the braking position so that release from the braking position may only occur when the pinion segment 32 is further displaced away from its braking position. The steps in the cam path 55 in the area of the neutral position operate so that the retainer pin 47 can only achieve the braking position in the direction of movement from the neutral position.

While the invention has been shown and described with respect to a particular embodiment thereof, this is for the purpose of illustration rather than limitation, and other variations and modifications of the specific embodiment herein shown and described will be apparent to those skilled in the art all within the intended spirit and scope of the invention. Accordingly, the patent is not to be limited in scope and effect to the specific embodiment herein shown and described nor in any other way that is inconsistent with the extent to which the progress in the art has been advanced by the invention.

What is claimed is:

1. A drawing machine carriage assembly comprising:

a horizontal guide rail;

a horizontal carriage movable on said horizontal guide rail;

a vertical guide rail on said horizontal carriage;

a vertical carriage movable on said vertical guide rail, a drawing head carried by said vertical carriage;

brake means for holding the horizontal carriage;

an operational element which activates said brake means;

a transmission including a rotatably mounted rod operatively coupling said operational element and said brake means, the operational element causing the rod to shift the brake means out of the neutral position into a releasably retained braking position; and retainer means for releasably securing the braking means in its braking position and for simultaneously releasing stress from the rod and the operational element, the operational element and the transmission being relieved of stress in the neutral position and in the braking position for free movement of the operational element along the rod.

2. A drawing machine carriage as set forth in claim 1, wherein said rod extends longitudinally along the length of the horizontal guide rail operates a pivot lever which activates the brake means; and wherein the operational element moves the pivot lever in the braking position and wherein retainer means releasably secure the pivot lever to release stress from the rod and from the operational element.

3. A drawing machine carriage as set forth in claim 2, wherein the operational element includes a press key which operates along an axis generally perpendicular to the drawing board.

4. A drawing machine carriage as set forth in claim 3, wherein the rod is a pinion rod with an axially extending tooth, the pivot lever pivots about an axis which is generally parallel to the pinion rod and supports a pinion segment on one end which engages the pinion rod, and the press key operates a slide bar which engages the pinion rod whereby pressing the press key causes the pinion rod to be engaged and rotated.

5. A drawing machine carriage as set forth in claim 4, wherein the brake means include a sleeve, a plunger which is axially slidably positioned in the sleeve, the plunger and the sleeve having brake linings on the surfaces which face each other and between which a part of the horizontal carriage travels, and a toggle mechanism which joins the plunger and the sleeve, the pivot lever pushing the toggle mechanism into its extended position by shifting to its braking position.

6. A drawing machine carriage as set forth in claim 5, wherein the sleeve and the plunger of the brake are freely positioned on the horizontal carriage.

7. A drawing machine carriage as set forth in claim 6, wherein the pivot lever is biased in the neutral position by first spring means;

the pinion segment which engages the pinion rod is movably positioned against the pivot lever by second spring means and is slightly movable away from the pivot lever upon release of the brake means from the braking position by the operational element by means of the pinion rod to release the retainer.

8. A drawing machine carriage as set forth in claim 7, wherein the retainer includes a pivotable and flexibly positioned retainer pin which is biased against the pinion segment and travels in a closed camming path in the pinion segment, the closed camming path rising against the retainer pin in the direction of operation from the neutral position to the braking position and in the direction of operation from the braking position to the neutral position, and decreases stepwise from the braking position respectively back to the neutral posi- tion.

9. A drawing machine carriage as set forth in claim 5, wherein the pivot lever is biased in the neutral position by first spring means, the pinion segment which engages the pinion rod is movably positioned against the pivot lever by second spring means and is slightly movable away from the pivot lever upon release of the brake means from the braking position by the operational element by means of the pinion rod to release the retainer.

10. A drawing machine carriage as set forth in claim 9, wherein the retainer includes a pivotable and flexibly positioned retainer pin which is biased against the pinion segment and travels in a closed camming path in the pinion segment, the closed camming path rising against the retainer pin in the direction of operation from the neutral position to the braking position and in the direction of operation from the braking position to the neutral position, and decreases stepwise from the braking position respectively back to the neutral posi- tion.

11. A drawing machine carriage as set forth in claim 4, wherein the pivot lever is biased in the neutral position by first spring means, the pinion segment which engages the pinion rod is movably positioned against the pivot lever by second spring means and is slightly movable away from the pivot lever upon release of the brake means from the braking position by the operational element by means of the pinion rod to release the retainer.

12. A drawing machine carriage as set forth in claim 11, wherein the retainer includes a pivotable and flexibly positioned retainer pin which is biased against the pinion segment and travels in a closed camming path in the pinion segment, the closed camming path rising against the retainer pin in the direction of operation from the neutral position to the braking position and in the direction of operation from the braking position to the neutral position, and decreases stepwise from the braking position respectively back to the neutral position.

13. A drawing machine carriage as set forth in claim 4, wherein the press key is connected to a gear rack which moves in the direction in which the key is pressed and which engages a pinion gear positioned perpendicularly to the gear rack, the pinon gear also engaging the slide bar for the activation of the pinion rod.

14. A drawing machine carriage as set forth in claim 4, wherein the pinion rod is positioned in a chamber of the vertical guide rail and is supported in a collar in the carriage chamber along the length of the pinion rod, whereby the pinion rod is longitudinally rotatable.

15. A drawing machine carriage as set forth in claim 2, wherein the brake means include a sleeve, a plunger which is axially slidably positioned in the sleeve, the plunger and the sleeve having brake linings on the surfaces which face each other and between which a part of the horizontal carriage travels, and a toggle mechanism which joins the plunger and the sleeve, the pivot lever pushing the toggle mechanism into its extended position by shifting to its braking position.

16. A drawing machine carriage as set forth in claim 15, wherein the sleeve and the plunger of the brake are freely positioned on the horizontal carriage.

17. A drawing machine carriage as set forth in claim 1, wherein the operational element includes a press key which operates along an axis generally perpendicular to the drawing board.

18. A drawing machine carriage as set forth in claim 17, wherein brake means are also provided for the vertical carriage, the brake means being activated by a prees key which has an axis of operation perpendicular to the drawing plane and which is located on the vertical carriage.

* * * * *